US006294780B1

(12) United States Patent
Wells et al.

(10) Patent No.: US 6,294,780 B1
(45) Date of Patent: Sep. 25, 2001

(54) PULSED ION SOURCE FOR ION TRAP MASS SPECTROMETER

(75) Inventors: Gregory J. Wells, Fairfield; Peter P. Yee, San Ramon; Marvin A. Ruport, Brentwood; Charles K. Huston, Fairfield, all of CA (US)

(73) Assignee: Varian, Inc., Palo Alto, CA (US)

( * ) Notice: Subject to any disclaimer, the term of this patent is extended or adjusted under 35 U.S.C. 154(b) by 0 days.

(21) Appl. No.: 09/285,806

(22) Filed: Apr. 1, 1999

(51) Int. Cl.[7] ..... H01J 49/16

(52) U.S. Cl. ..... 250/288

(58) Field of Search ..... 250/292, 282, 250/288

(56) References Cited

U.S. PATENT DOCUMENTS 5,381,006 * 1/1995 Wells et al. ..... 250/282
5,569,917 * 10/1996 Butrill, Jr. et al. ..... 250/292
6,040,575 * 3/2000 Whitehouse et al. ..... 250/288

OTHER PUBLICATIONS

Patent Abstracts of Japan entitled of "Ion Source" published Jul. 5, 1986, vol. 10, No. 032.
Patent Abstracts of Japan entitled of "Ion Source For Mass Spectrometer" published Sep. 26, 1985.

* cited by examiner

*Primary Examiner*—Jack Berman
*Assistant Examiner*—Johnnie L Smith, II
(74) *Attorney, Agent, or Firm*—Edward H. Berkowitz

(57) ABSTRACT

An ion source for use with an ion trap mass spectrometer. The ion source includes an electron source which produces a stream of electrons. The electrons are injected into an ionization chamber by the action of a repeller plate and electron lens. Inside the ionization chamber, the electrons interact with a gas-phase sample to produce sample ions through the electron ionization process, or with a reagent gas to form reagent ions as part of a chemical ionization process. The sample ions produced are extracted from the ionization chamber by the action of an ion repeller and an ion lens. The potentials on the electron repeller and lens, and ion repeller and lens are controlled to direct the electron stream away from the ionization chamber or to direct the sample ion beam away from an ion trap at the appropriate times during measurement of the sample ions.

13 Claims, 7 Drawing Sheets

Electron Lens
On
+Von
0
Time
−Voff
Off
Off

Electron Repeller
On
+Voff
0
Time
−Von
Off
Off

Ion Lens 1
Off
Off
+Voff
0
Time
−Von
On
Stabilization Time
1−10 microseconds

Electron Lens
On
+Von
0
Time
−Voff
Off
Off

Electron Repeller
On
+Voff
0
Time
−Von
Off
Off

Ion Lens 1
Off
Off
+Voff
0
Time
−Von
On
Reaction Stabilization Time
1−10 milliseconds

PULSED ION SOURCE FOR ION TRAP MASS SPECTROMETER

FIELD OF THE INVENTION

The present invention relates to apparatus and methods for characterizing materials using mass spectrometry, and more specifically, to a pulsed ion source for use with an ion trap mass spectrometer.

BACKGROUND OF THE INVENTION

Mass spectrometers have become common tools in chemical analysis. Generally, mass spectrometers operate by separating ionized atoms or molecules based on differences in their mass-to-charge ratio (m/e) and thereafter, detecting ions of different ratios. A variety of mass spectrometer devices are commonly in use, including ion traps, quadrupole mass filters, and magnetic sector devices.

The general steps in performing a mass-spectrometric analysis are: (1) create gas-phase ions from a sample, wherein gaseous samples may first be separated by a gas chromatograph (GC) before undergoing analysis in a mass spectrometer; (2) separate the ions in space or time based on their mass-to-charge ratio; and (3) measure the quantity of ions of each selected mass-to-charge ratio. Thus, in general, a mass spectrometer system consists of an ion source, a mass-selective analyzer, and an ion detector. In the mass-selective analyzer, magnetic and electric fields may be used, either separately or in combination, to separate the ions based on their mass-to-charge ratio. Hereinafter, the mass-selective analyzer portion of a mass spectrometer system will be referred to as a mass spectrometer.

An ion trap mass spectrometer uses electrodes to contain or "trap" the ions in a small volume, and then selectively ejects the ions from that volume to a detector. There are two primary types of ion trap mass analyzers: a three-dimensional quadrupole ion trap; and an ion cyclotron resonance (ICR) ion trap. A quadrupole ion trap contains the ions formed from a sample material in the trap and uses DC and RF electric fields to manipulate the ions to select a desired mass-to-charge ratio for detection and measurement of the number of ions. Typically, a quadrupole ion trap mass analyzer consists of a ring electrode separating two (end-cap) electrodes. The surfaces of both the ring and end-cap electrodes are generally hyperbolic in cross-section. The RF and DC potentials on the electrodes can be scanned to eject ions of a specific mass-to-charge ratio from the trap, where they are detected and counted. An ICR type ion trap uses magnetic confinement in the radial direction and DC confinement in the axial direction to contain the ions in the trap.

The sample material from which the ions are formed can be directed into the interior of the ion trap and ionized within the region between the trapping electrodes. Alternately, the sample can be introduced into an ion source external to the trapping region, ionized, and the resulting sample ions injected into the ion trap.

The ions formed within or external to the ion trap are typically produced as a result of either an electron ionization (EI) or chemical ionization (CI) process. In the EI method, a beam of electrons is directed into the gas-phase sample. Electrons collide with neutral sample molecules, producing ions of the sample molecule, or of fragments of the molecules.

One prior art ion source for producing electron ionization inside of an ion trap uses pulsed, low energy (~11 eV) electrons, which are injected into the interior of the ion trap electrode structure through a hole in an end-cap electrode. The RF trapping field then accelerates the electrons to a kinetic energy sufficient to fragment the neutral sample molecule(s) and form ions by electron ionization. Such a device is described by Stafford et al. in U.S. Pat. No. 4,540,884.

Bier et al. (U.S. Pat. No. 5,756,996) describes an external EI ion source that creates sample ions outside of the trap which are then injected into the trapping region. External sources such as that described in Bier et al. typically include a magnet with its field oriented along the axis of ionization to cause electrons to travel in small spiral trajectories. The resulting electron beam traverses the ionization region. Bier et al. teaches a method of controlling the energy of the electrons injected into the ion-forming volume of the external ion source. The Bier method is employed to ensure that the electron beam energy is sufficient to ionize atoms and molecules in the source during a specified ionizing period, and insufficient to ionize or excite helium (which is conventionally used as a carrier gas) at other times.

However, a disadvantage of the prior art method of internal ionization described in Stafford et al. is that the large surface area of the trap electrodes necessarily comes into contact with the sample introduced within them for ionization. The large surface area of the electrodes often reduces the sensitivity when certain types of samples are analyzed, such as highly polar compounds. This is believed to be due to the absorption of the sample on the metal electrodes. The simultaneous presence of the neutral sample molecules and the charged ion fragments within the ion trap can also cause undesired ion/molecule reactions.

In contrast, the use of an external ion source with a substantially reduced volume and electrode surface area greatly reduces the problem of sample absorption and ion/molecule reactions. An external ion source also ensures that only the ions injected into the ion trap will be present in the trap, and that the neutral sample molecules remain in the external source until they are removed by a vacuum pump. Undesired ion-molecule reactions within the ion trap can thus be substantially eliminated by using an external source.

However, a significant disadvantage of a conventional external ion source is the rate at which it becomes contaminated by sample molecules that are dissociated by collisions with electrons. In this regard, reducing the electron energy as taught by Bier et al. will reduce the photon noise caused by electron impact ionization of neutral molecules and the background of helium carrier gas used for GC. However, a chemical bond can be broken with an electron energy of only a few electron volts, which is a level far below the energy threshold for noise formation or electron impact ionization. This means that the Bier et al. approach is capable of reducing the photon noise without satisfactorily addressing the molecule dissociation problem. This is because contamination arising from sample molecule dissociation can occur without introducing significant photon noise into the measurements.

However, the method of Bier et al. cannot be used to reduce the electron energy to zero in order to reduce this potential contamination. The electron emission from a heated filament is governed by the Child-Langmuir Law for space-charge limited current flow. This law states that the maximum charged current (I) that can leave a heated filament and travel to the counter electrode, which is at a potential (V), is given by $I=K\ V^{3/2}$. Thus, the current is a strong function of the filament bias voltage, which determines the electron energy. Applying the Bier et al. approach by reducing the electron energy to a value that will prevent electron impact ionization and molecule dissociation will thus also significantly reduce the electron emission current. This result is undesirable for the following reason.

It is known to regulate the emission current for mass spectrometry applications to ensure a stable response from the sample molecules. The regulating circuits generally have a long time constant for responding to changes in the emission current. This prevents over-heating of the filament during the initial heating of the filament, when there is little or no electron emission occurring. Thus, small changes in the filament bias voltage typically cause large changes in emission currents, resulting in a long filament emission regulator circuit response time. If the filament bias voltage is too small, then the negative space charge due to the electrons will prevent any further increase in the electrons leaving the filament, as described by the Child-Langmuir Law. In this case, the emission regulator circuit will increase the heating current through the filament until the filament melts and breaks. Therefore, it is desirable to maintain a constant electron emission current from the filament and to preserve the physical integrity of the filament.

In the method of Bier et al., during the period in which ions are not to be formed, the reduction of the filament bias voltage is accompanied by an increase in the voltage applied to the electron lens. This serves to maintain an approximately constant electron energy, until the electrons pass through the electron lens. This is important because even small changes in the electron energy will cause a large variation in the filament emission current. For a space charge limited planar diode, the Child-Langmuir Law takes the form of $I=K\ V^{3/2}/X^2$, where X is the distance between the electrodes. Thus the emission current cannot truly be kept constant by changing the voltages on two different electrodes that are located at different distances from the filament. Since the electron emission cannot remain constant during the time required for the emission regulating circuit to respond to the change in bias voltage, the number of ions formed will not be linearly proportional to the ionizing time. This is undesirable because it complicates the process of interpreting the results of the ion measurement process.

In the CI method, ion-molecule reactions are used to produce sample ions. A reagent gas (such as methane, isobutane, or ammonia) is ionized by interaction with an electron beam. A sufficiently high reagent gas pressure can produce ion-molecule reactions between the reagent gas ions and reagent gas molecules. Some of these reaction products can then react with the sample molecules to produce sample ions.

Reagent ion formation may result from a complex set of chemical reactions. In order to maintain a stable CI reaction with a sample molecule, the reagent ions must be maintained at a constant concentration. Therefore, it is desirable that the reagent ions achieve an equilibrium level before the sample ions begin to react. The equilibrium time will be different for different chemical reagent molecules, but is generally on the order of 1–10 milliseconds. Since the reagent ion/molecule reactions that are a precursor to the formation of the sample ions may require a variety of different reaction times, a stabilization time is necessary to allow the reagent ions to achieve chemical equilibrium so that the concentration of reagent ions doesn't change during the ionization time. However, the Bier et al. method teaches that the ionization period begins by increasing the electron energy to produce ionization within the ion volume of the ion source; the CI reactions start simultaneously, and ions are introduced into the ion trap. Thus, no means is provided for eliminating any undesired effects from the non-equilibrium state of reagent ions at the beginning of the ionization period.

What is desired is an ion source for use with an ion trap mass spectrometer which overcomes the noted disadvantages of conventional ion sources.

SUMMARY OF THE INVENTION

The present invention is directed to an ion source for use with an ion trap mass spectrometer. The inventive ion source includes an electron source which produces a stream of electrons. The electrons are injected into an ionization chamber (ion-forming volume) by the action of a repeller plate and electron lens. Inside the ionization chamber, the electrons interact with a gas-phase sample to produce sample ions through the electron ionization process, or with a reagent gas to form reagent ions as part of a chemical ionization process. The sample ions produced are extracted from the ionization chamber by the action of an ion repeller and an ion lens. The potentials on the electron repeller and lens, and ion repeller and lens are controlled to direct the electron stream away from the ionization chamber or to direct the sample ion beam away from an ion trap at the appropriate times during measurement of the sample ions.

An alternate means of removing ions from the ionization chamber is to use only an ion lens to extract the ions (instead of using the combination of a lens and an ion repeller). This may require an increase in the ion exit aperture through which the ions exit the ionization chamber. For example, a CI mode ionization chamber may not require use of an ion repeller to extract the ions from the chamber. Since the sample ions are formed inside the chamber at significantly higher pressures than in the surrounding vacuum chamber, the ions can exit the chamber as part of the gas flow.

DETAILED DESCRIPTION OF THE INVENTION

The present invention is directed to an ion source for producing ions from a gas phase sample prior to introduction of the sample ions into an ion trap mass analyzer of a mass spectrometer. The external ion source of the present invention produces a constant emission, constant electron energy beam whose direction is varied to cause the ionizing beam to intersect with or be diverted from the gas-phase samples residing in an ion formation region. The direction of the electron beam is controlled so that the beam is directed into the ion formation volume during the time in which sample ions are to be admitted into the ion trap, and the electron beam is directed away from the ion volume during the time in which ions are not to be admitted into the ion trap. This reduces the contamination of the ion source output by dissociated sample molecules, while maintaining a stable sample molecule response to the electron beam and preserving the integrity of the filament which serves as the source of the electrons. The constant emission current of the ionizing electron beam ensures that the number of sample ions formed is proportional to the ionizing period. This assists in interpreting the results of the sample ion measurement process.

The inventive ion source can be used with an electron or chemical ionization process. An ion lens gate, synchronized with the electron lens gate, is used to define a stabilization time between when the electrons are admitted into the ion forming volume and when the ions are allowed to enter the ion trap. This provides a means of ensuring an equilibrium situation for the reagent ions used as part of the chemical ionization process. This also provides a means of ensuring that transient effects or perturbations of the electron emission current or ion current due to switching the direction of the electron beam do not affect the number of ions that enter the ion trap.

Figure 1:
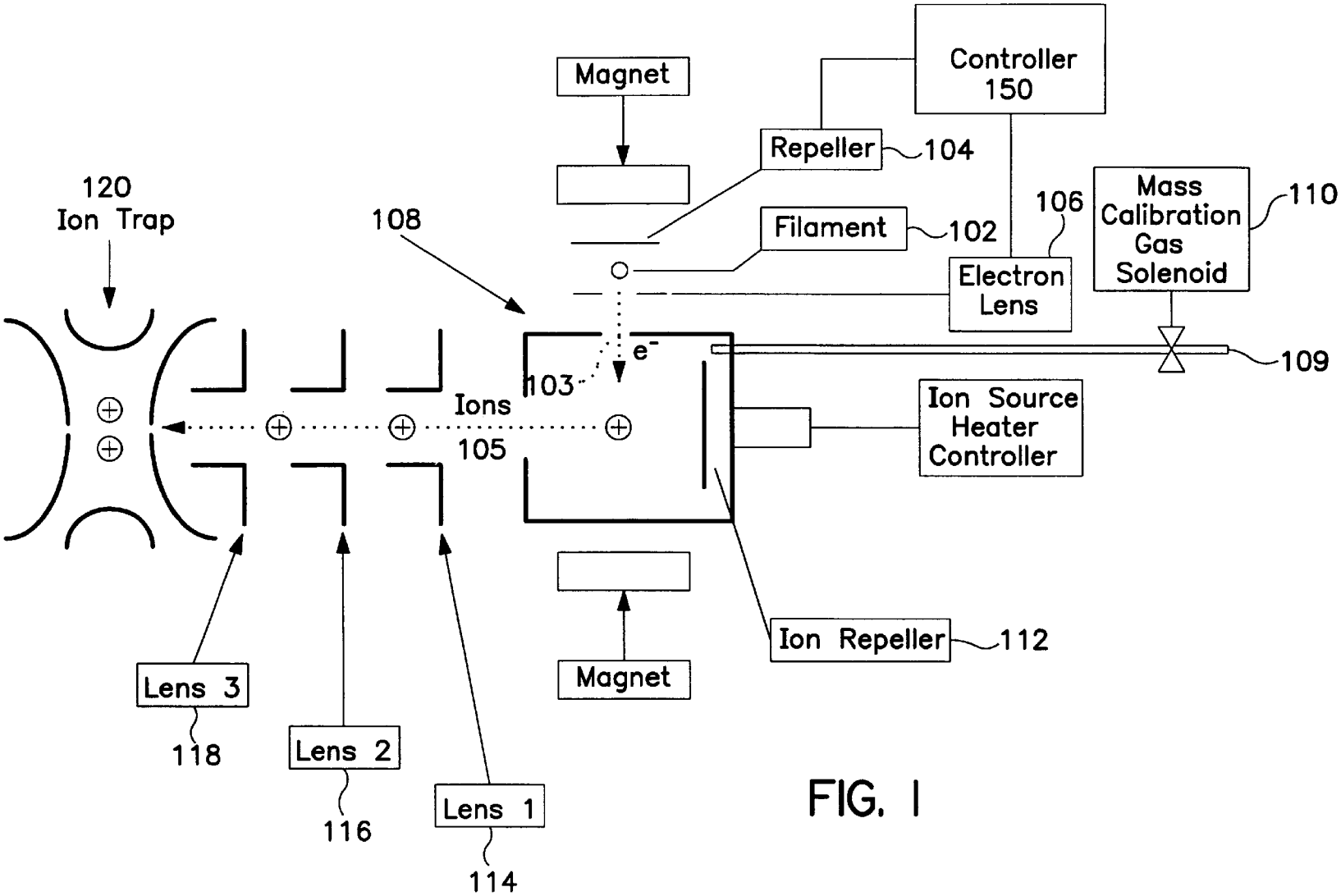
FIG. 1 is a schematic block diagram of the external pulse ion source for an ion trap mass spectrometer of the present invention.

FIG. 1 is a schematic block diagram of the external pulse ion source for an ion trap mass spectrometer of the present invention. A heated filament 102 serves as an electron source and is preferably located equidistant between a repeller plate 104 and an electron lens 106. Repeller plate 104 is preferably a flat plate made of non-magnetic stainless steel. Filament 102 is preferably a ribbon (with a rectangular cross section) or wire (with a circular cross section) of a thermionic material, as is well known. In one embodiment, filament 102 is held at a bias voltage of −70 volts relative to the grounded ion source 108 (which may be referred to as an ionization chamber or ion-forming volume) in which the sample ions are formed. In the figure, electron lens 106 is shown as a plate, like repeller 104, but with a rectangular slot aligned with filament 102. Note that adding a slot in electron repeller plate 104 that is identical to the slot in electron lens 106 has been found to improve the symmetry of the electric fields between them when the polarity is reversed. Note also that the slot could be replaced with a circular hole or other suitable shape.

Electrons 103 produced by filament 102 are directed into the inside of ion source 108 through an entrance port. Inside ion source 108 the electrons collide with neutral sample molecules, which are typically provided by the output of a gas chromatograph 109. The collisions produce a stream of charged ions 105. If desired, a calibration gas may be introduced using mass calibration gas solenoid 110. Ions 105 can be extracted from an exit port of ion source 108 by using a second ion repeller plate 112. This is done through the mechanism of an electric potential developed between ion repeller plate 112 (having a potential of the same polarity as the ion) and the opposite wall of ion source 108. Alternately, the ions can be extracted from ion source 108 by an electric potential developed between the ion source 108 (when no ion repeller plate is present) and first ion lens 114 exterior to the ion volume. The first ion lens (the "extractor lens") 114 has a polarity that is opposite in sign from the ions formed within the interior of ion source 108. After extraction from source 108, the ions are transported and focused by a series of one or more ion lens(es) 116 and 118 into an aperture in one of the end-cap electrodes of quadrupole ion trap 120 (or other suitable type of ion trap).

An electron extraction field is used to direct electrons 103 formed by filament 102 through the entrance port and into the ion source 108. This field is developed by applying a negative voltage to repeller 104 and a positive voltage to electron lens 106. If filament 102 is located equidistant between repeller plate 104 and electron lens 106, then the voltages on the repeller and lens will be of equal magnitude, but opposite in sign.

Figures 2A, 2B, 2C:
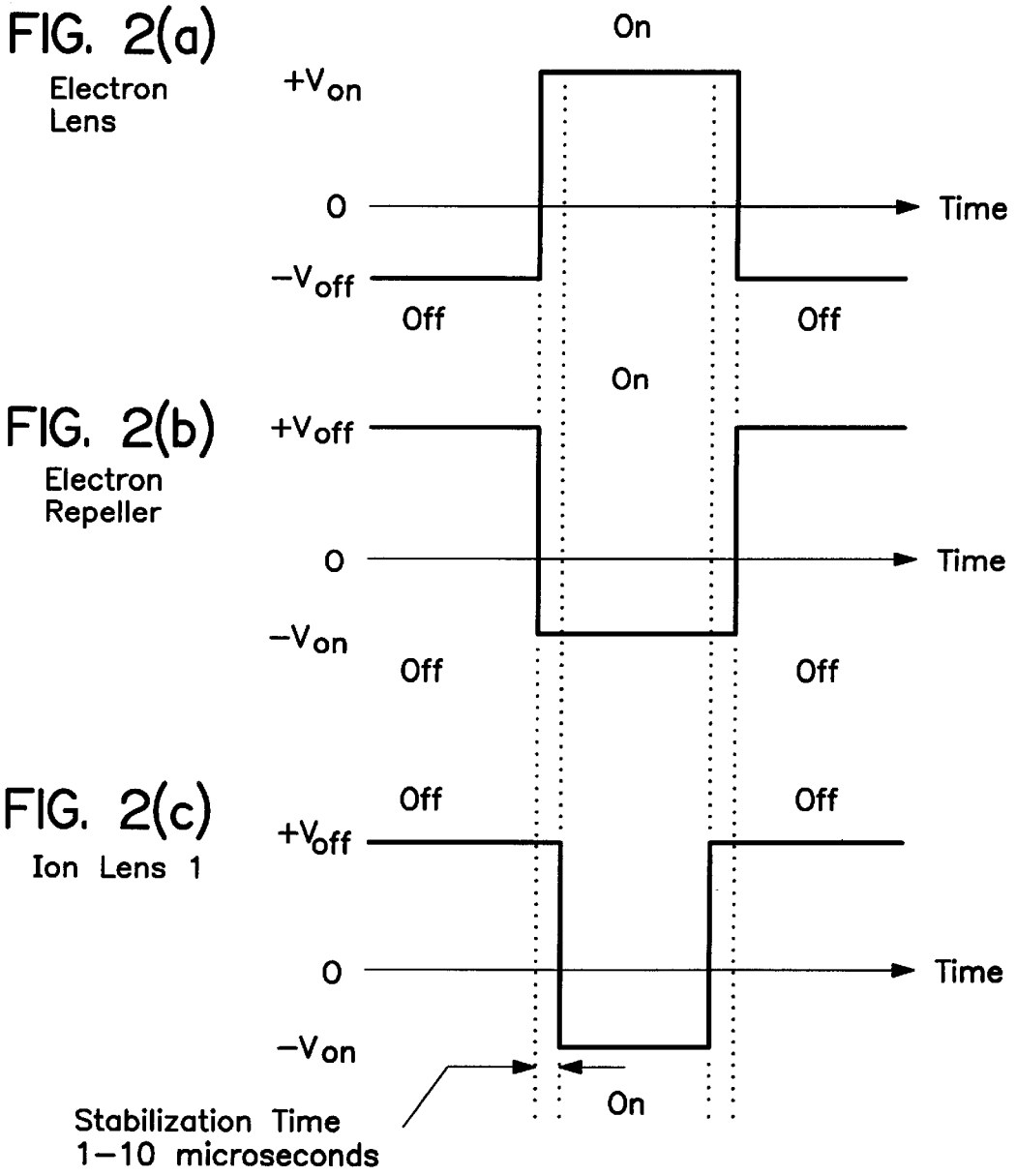
FIGS. 2(*a*) to 2(*c*) are timing diagrams showing the potential applied to the electron lens, electron repeller plate, and ion lens as a function of time during the operation of the pulsed ion source of the present invention when it is used in an electron ionization mode.

FIGS. 2(*a*) to 2(*c*) are timing diagrams showing the potential applied to electron lens 106 (FIG. 2(*a*)), electron repeller plate 104 (FIG. 2(*b*)), and ion lens 114 (FIG. 2(*c*)) as a function of time during the operation of the pulsed ion source of the present invention when it is used in an electron ionization mode. The timing diagrams shown in FIG. 2 indicates that when ion formation is occurring as a result of the electron beam intersecting sample molecules (as designated by the label "On" in the figure), the voltages on the repeller and the lens are of opposite polarity. This acts to cause the electrons released by the filament to be directed into the ion volume. When the ionization process is turned off (as designated by the label "Off" in the figure), the voltages are set to direct the electrons away from the ion volume (by reversing the polarity of the repeller and lens voltage so as to deflect the electron beam away from the opening into the ion forming volume).

The described control scheme for the electron lens 106 and electron repeller 104 potentials causes the magnitude of the electric field between the repeller and the lens, as well as the field between the filament and each of these structures, to remain constant in magnitude and change only in sign. Therefore, there is virtually no perturbation of the electron emission process from the filament. This preserves the physical integrity of the filament and maintains the ion production process at an approximately constant level. Note that as a practical matter, the tolerances that can be achieved, or accepted, between the location and shape of the filament relative to the electron repeller and lens could result in the optimum voltages on the repeller and lens being slightly different.

Controller 150 contains the circuitry used to control the electric potentials applied as a function of time to electron repeller 104, electron lens 106, ion repeller 112, and ion lens 114. Controller 150 may also be used to control the operation of filament 102 and additional ion lenses. In controlling the potentials mentioned, it is desirable to use voltage switching electronics that do not require either high precision switching times, or precise voltage tracking. Note that when such electronic circuits change the polarity of the electron repeller and electron lens potentials, there may be a short period of time when the electric field between those structures is not constant in magnitude. To ensure that the magnitude of the ion current entering ion trap 120 is linearly related to the ionization "On" time, a second gating electrode 118 can be used to control the ion beam 105 leaving ion source 108. Ion lens 118 can be set to a high positive voltage (during the time period in which positive ions are formed in ion source 108) to deflect the ion stream away from the entrance to ion trap 120.

Alternately, other lens elements located between ion source 108 and ion trap 120 can be used as a gate (such as ion lens 116). It may be preferable to use a lens closer rather than farther from ion source 108 to avoid accumulating ions between the ion source and the lens used as the gate. To admit ions 105 into trap 120, ion lens 118 can be set to a negative voltage that focuses the ion stream 105 into trap 120.

As shown in the timing diagram of FIG. 2(*c*), the ion lens potential (labeled "Ion Lens 1") is set to the "off" state before the electrons from the filament are directed into ion source 108. As shown, the potentials on electron lens 106 and electron repeller 104 are set to direct electron beam 103 into ion source 108, and after a "stabilization time", the potential of ion lens 114 is switched to the "on" state to direct ions 105 into ion trap 120. At the end of the ionization period, the potential of ion lens 114 is set to the "off" state. After a suitable delay, this is followed by changing the potentials on the electron lens 106 and repeller 104 to direct the electron beam away from the ion forming volume. Under this control scheme, switching transients or perturbations caused by the changing fields that could affect the ionization process in the ion volume are prevented from affecting the ions that enter the ion trap. Typical stabilization times used when operating the pulsed ion source of the present invention are on the order of 5–50 microseconds.

Figures 3A, 3B, 3C:
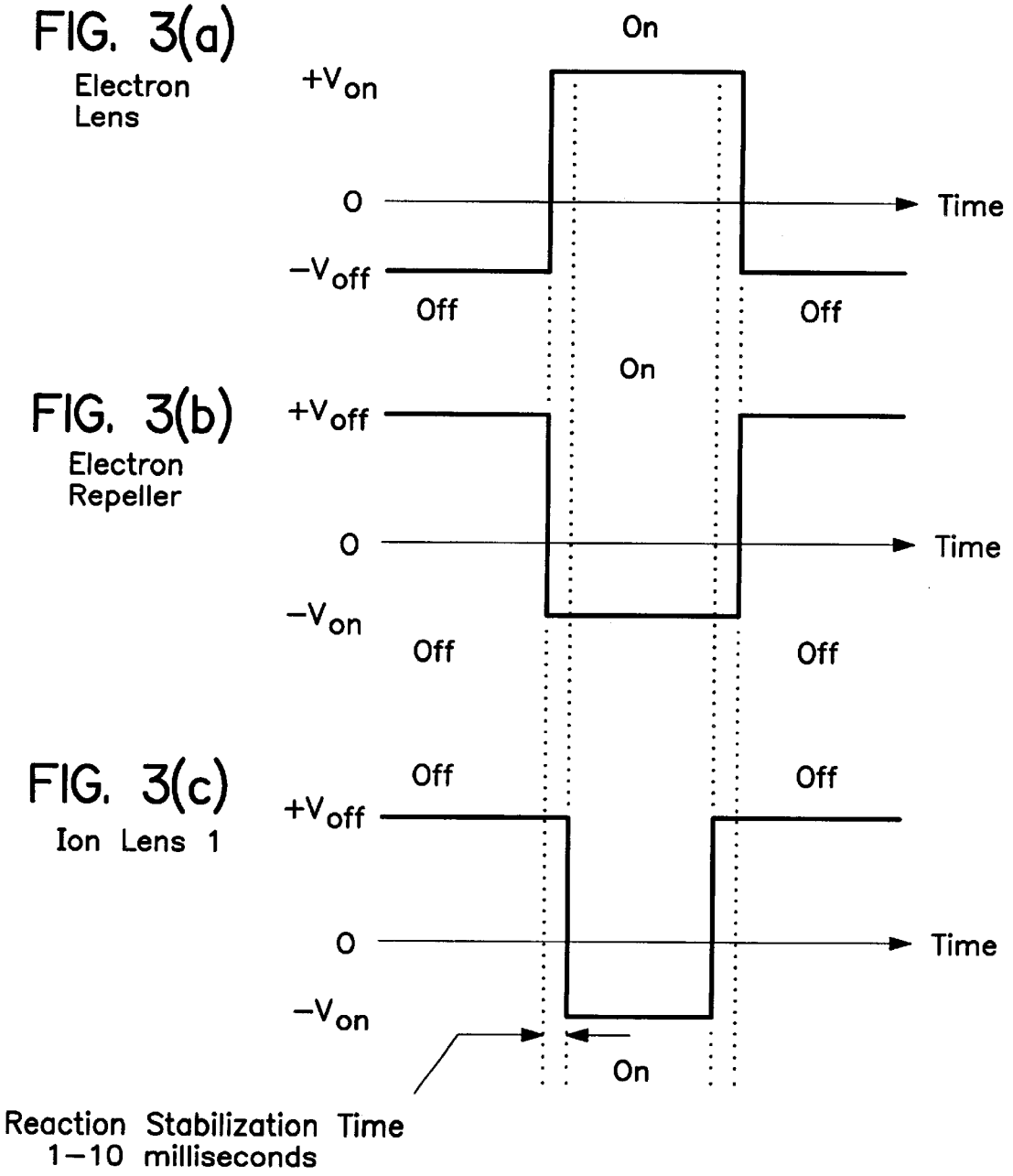
FIGS. 3(*a*) to 3(*c*) are timing diagrams showing the potential applied to the electron lens, electron repeller plate, and ion lens as a function of time during the operation of the pulsed ion source of the present invention when it is used in a chemical ionization mode.

FIGS. 3(*a*) to 3(*c*) are timing diagrams showing the potential applied to electron lens 106 (FIG. 3(*a*)), electron repeller plate 104 (FIG. 3(*b*)), and ion lens 114 (FIG. 3(*c*)) as a function of time during the operation of the pulsed ion source of the present invention when it is used in a chemical ionization mode. This mode is similar to the electron ionization mode, except that the "stabilization time" is longer (on the order of 1–10 milliseconds). The longer time is desired because the chemical equilibrium of the reagent ions must be stabilized.

Figure 4:
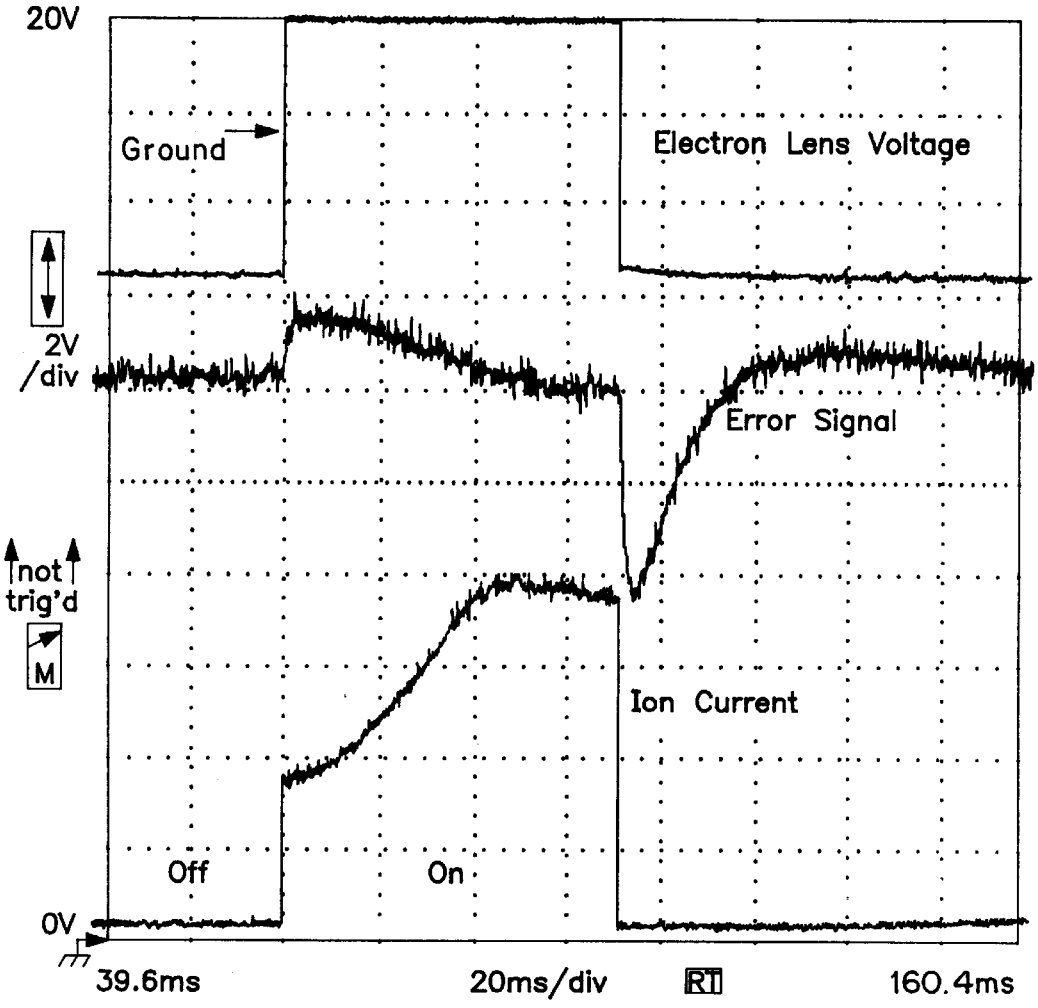
FIGS. 4–6 are graphs showing the effect of changing the electric field around the filament for the situation of a prior art control scheme (FIG. 4) and for the ion source of the present invention (FIGS. 5 and 6).
Figure 5:
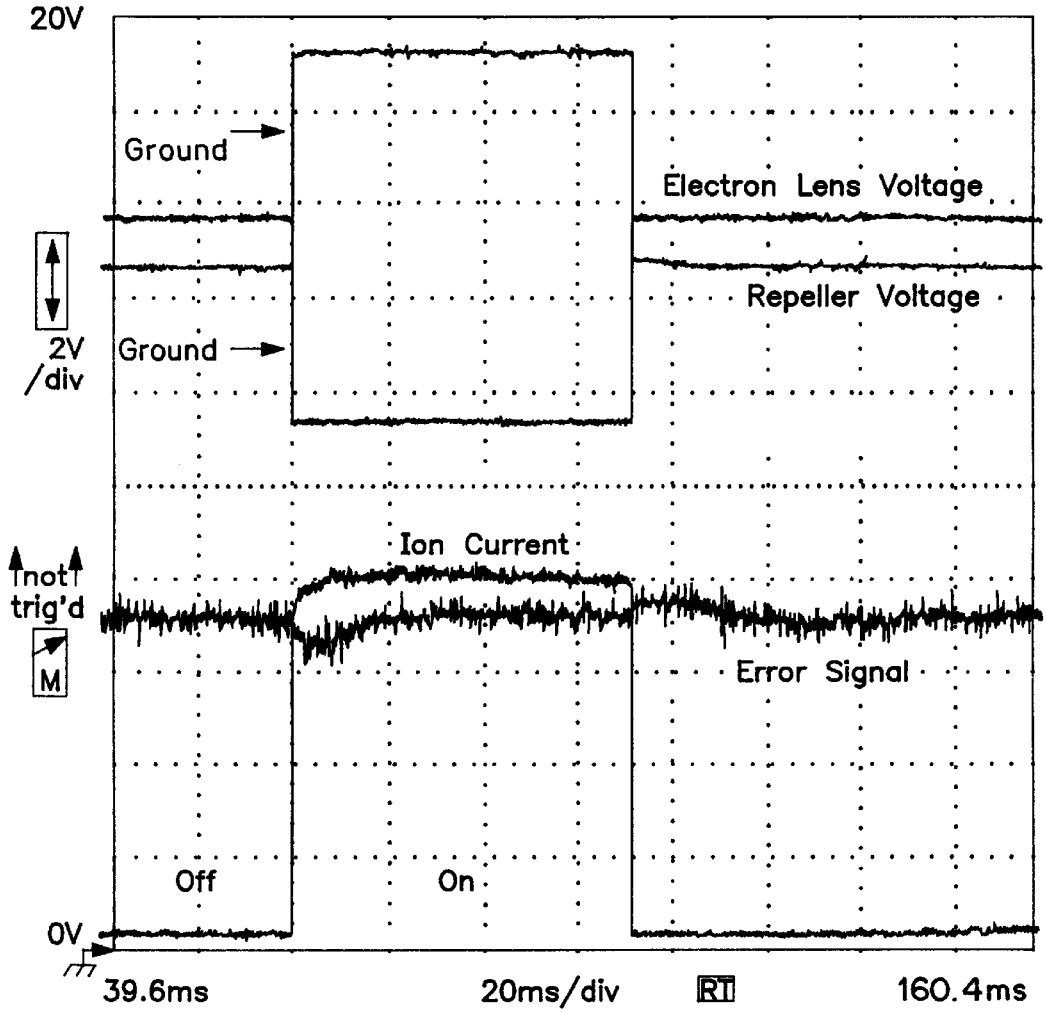
Figure 6:
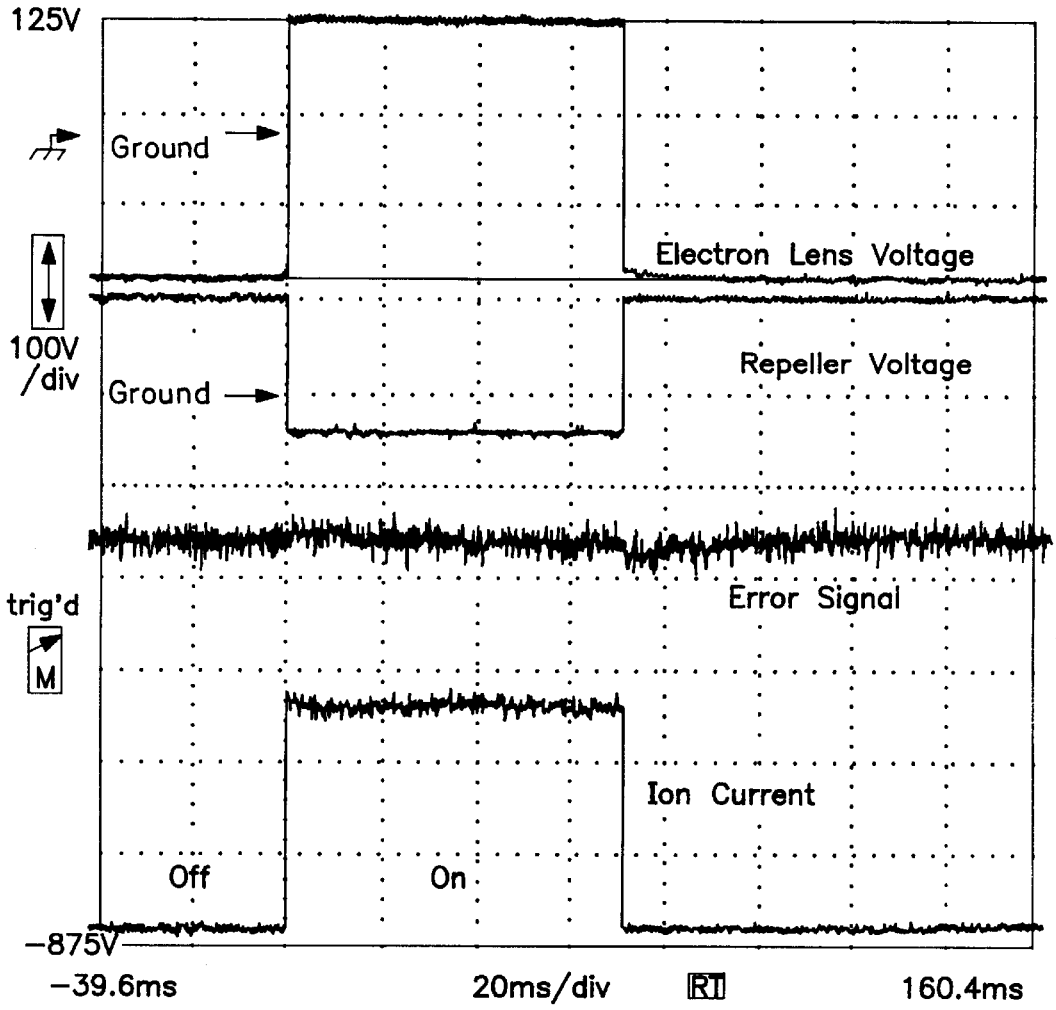

FIGS. 4–6 are graphs showing the effect of changing the electric field around the filament for the situation of a prior art control scheme (FIG. 4) and for the ion source of the present invention (FIGS. 5 and 6). FIG. 4 shows the effect of changing the electric field around the filament for the case of the electron repeller plate at a constant −100 volts, and a filament bias of −70 volts. In the figure, the electron lens is switched from a potential of −150 volts (off) to +100 volts (on). The instantaneous change in the emission current causes the emission regulator circuit to change the current through the filament. The "error signal" is the difference between the set value of the emission current and the actual value of the emission current, measured at the output of the control circuit amplifier. As illustrated by the figure, the perturbation of the emission current causes a variation in the ion current measured outside of the ion source. The slow increase in the ion current is due to the slow increase in the current through the filament. This in turn, causes a slow increase in the electron emission from the filament.

FIG. 5 shows the effect of changing the electric field around the filament for the preferred embodiment of the invention. In this case, the filament is equidistant between the repeller plate and the electron lens, and has a bias of −70 volts. When the electrons are directed away from the ion volume (off) the repeller has a voltage of +124 volts and the lens has a voltage of −124 volts. When electrons are directed into the ion volume (on) the repeller has a voltage of −124 volts and the lens potential is +124 volts.

FIG. 6 shows the results for an alternate arrangement of the filament and repeller to that responsible for the graph of FIG. 5. In this arrangement, the filament is located 0.030" from the electron lens and the repeller is located 0.125" from the filament. The asymmetry in the position of the filament between the repeller plate and the electron lens causes the optimum voltages on these elements to be different in both magnitude and sign, for both the "on" and "off" states from those of FIG. 5. Note that in contrast to FIG. 4, FIGS. 5 and 6 indicate that the magnitude of the ion current and error signal undergo substantially less variation when the inventive structure and control method are used.

Alternate embodiments of the present invention include, but are not limited to the asymmetrical location of the filament between the repeller and the electron lens. As noted when discussing FIG. 6, this embodiment requires the voltages applied to each electrode (i.e., the repeller and electron lens) to be of a different magnitude when the emission current is gated on and off.

Figure 7:
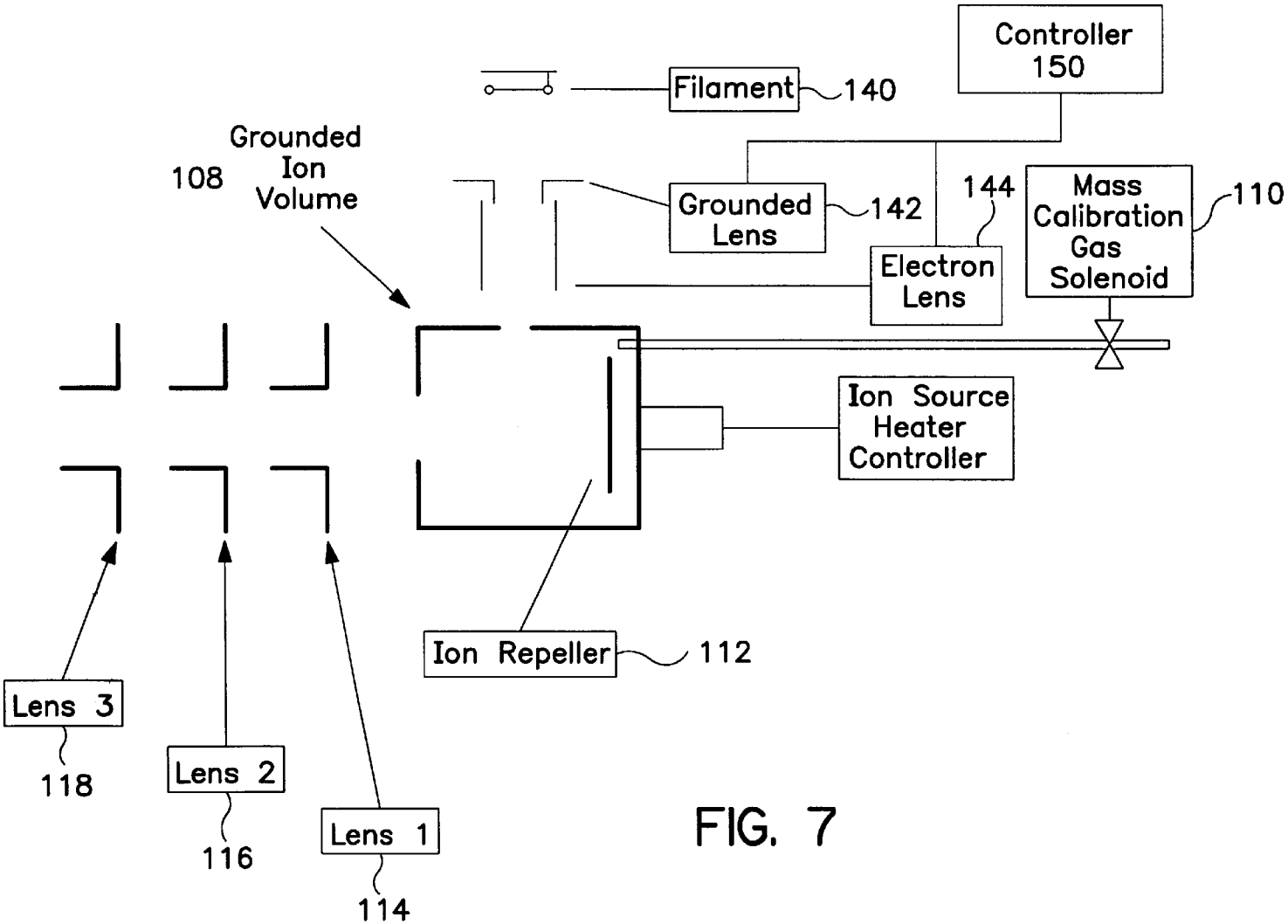
FIG. 7 is a schematic block diagram of an alternative embodiment of the external pulse ion source for an ion trap mass spectrometer of the present invention.

An alternative embodiment of the inventive ion source is shown in FIG. 7. In this embodiment, the bias voltage between filament 140 and a grounded lens 142 positioned in front of it, remains constant. An electron lens 144 is used to gate the electrons produced by filament 140 into ion forming source 108 or away from an entrance port into source 108. Electron lens 144 has a positive value when the electrons are gated into ion source 108 during the formation of sample ions (the ionization period). Electron lens 144 is set to a large negative value when the ionization period is ended. Grounded lens 142 in front of filament 140 should be of a sufficient length and a sufficiently small internal diameter so that the electric field of electron lens 144 does not penetrate into the region between filament 140 and grounded lens 142. This is to prevent any disturbance to the electron emission from filament 140. This embodiment of the invention has the potential disadvantage that the length of the ion source assembly is longer than that for the preferred embodiment of FIG. 1. Therefore, it may be less desirable when using a collimating magnet along the ionization axis because additional separation is required between the pole faces of the magnet.

The present invention is a controllable ion source for use with an ion trap mass spectrometer. The inventive source provides a means of producing a constant emission, constant electron energy stream in which only the direction of the electron extraction electric field (and hence the direction of travel of the electron beam) is changed during the ionization period. This reduces the stress on the electron producing filament and regulates the production of sample ions. The invention provides a device for forming ions which is external to an ion trap mass spectrometer, and in which the ionizing electron beam is directed into the ion volume only during the time in which ions are to be admitted into the ion trap for measurement, and is directed away from the ion volume during the time in which ions are not to be admitted into the ion trap. This mode of operation acts to reduce the chemical contamination of the ion volume and ion lens. The invention provides a means of ensuring equilibrium for the reagent ions used for chemical ionization by using an ion lens gate, synchronized with the electron gate, so that a defined stabilization time can be introduced between the time when the electrons are admitted into the ion volume and when the ions are allowed to enter the ion trap. The defined stabilization time also ensures that residual transient effects or perturbations of the electron emission current or ion current due to switching of the direction of the electron beam do not affect the number of ions that enter the ion trap.

The terms and expressions which have been employed herein are used as terms of description and not of limitation, and there is no intention in the use of such terms and expressions of excluding equivalents of the features shown and described, or portions thereof, it being recognized that various modifications are possible within the scope of the invention claimed.

What is claimed is:

1. An ion source for producing ions of a sample undergoing analysis, comprising:

a source of electrons;

an ionization chamber having an entrance through which electrons produced by the source of electrons may be injected and an exit through which ions of the sample produced within the ion source volume may be extracted;

a first electrode;

a second electrode, wherein the source of electrons is positioned between the first and second electrodes, and the second electrode is positioned between the source of electrons and the entrance to an ionization chamber; and a controller configured to control the electric potentials applied to the first and second electrodes, wherein the controller operates to apply electric potentials to the first and second electrodes to inject electrons into the ionization chamber during periods when ionization is desired, and operates to apply different electric potentials to the first and second electrodes to direct said electrons away from said ionization chamber during periods when ionization is not desired.

2. The ion source of claim 1, wherein the source of electrons is a filament.

3. The ion source of claim 1, wherein the source of electrons is located equidistant between the first and second electrodes.

4. The ion source of claim 3, wherein the electric potentials applied to the first and second electrodes are of the same magnitude and of opposite polarity.

5. The ion source of claim 1, further comprising:

a source of gas-phase sample molecules; and a means of introducing the gas-phase molecules into the ionization chamber.

6. An ion trap mass spectrometer system, comprising:

a source of sample ions comprising a source of electrons;

a first electrode;

a second electrode, wherein the source of electrons is positioned between the first and second electrodes, with the second electrode positioned between the source of electrons and an entrance to an ionization chamber;

an ionization chamber having an entrance through which the electrons produced by the source of electrons may be injected and an exit through which ions produced within the chamber may be extracted; and a controller configured to control the electric potentials applied to the first and second electrodes, wherein the controller operates to apply electric potentials to the first and second electrodes to inject electrons into the ionization chamber during periods when ionization is desired, and operates to apply different electric potentials to the first and second electrodes to direct said electrons away from said ionization chamber during periods when ionization is not desired; and an ion trap having an entrance through which the ions produced by the ionization chamber are directed.

7. The mass spectrometer system of claim 6, wherein the source of electrons is a filament.

8. The mass spectrometer system of claim 6, further comprising:

a source of gas-phase sample molecules; and a means of introducing the gas-phase molecules into the ionization chamber.

9. The mass spectrometer system of claim 6, further comprising:

a first ion control electrode positioned within the ionization chamber; and a second ion control electrode positioned outside the ionization chamber in a path of the ions produced within the chamber, wherein the controller operates to apply electric potentials to the first and second ion control electrodes to extract the ions produced within the chamber from the chamber.

10. A method of producing sample ions from a gas-phase sample for introduction to an ion trap of a mass spectrometer, comprising:

providing a source of electrons disposed between a first electrode and a second electrode;

applying an electric potential of the opposite polarity as the electrons to the first electrode and an electric potential of the same polarity as the electrons to the second electrode at time $t_1$ to initiate the injection of electrons generated by the source of electrons into an entrance port of an ionization chamber;

providing gas-phase sample atoms or molecules to the inside of the ionization chamber;

providing a first ion control electrode inside the ionization chamber and a second ion control electrode external to the ionization chamber;

applying an electric potential of the opposite polarity to the ions formed from the gas-phase sample to the first ion control electrode and an electric potential of the same polarity as the formed ions to the second ion control electrode at time $t_2$ to extract the formed ions from the ionization chamber;

applying an electric potential of the same polarity to the ions formed from the gas-phase sample to the second ion control electrode at time $t_3$; and applying an electric potential of the same polarity as the electrons to the second electrode at time $t_4$ to discontinue the injection of electrons generated by the source of electrons into the entrance port of the ionization chamber, where $t_1<t_2<t_3<t_4$.

11. The method of claim 10, wherein the first and second electrodes are positioned equidistant from the source of electrons, and further, wherein the electric potential applied to the first and second electrodes is of the same magnitude but opposite in polarity.

12. The method of claim 10, wherein the difference between time $t_2$ and time $t_1$ is approximately in the range of 1 to 10 micro-seconds.

13. The method of claim 10, wherein the difference between time $t_2$ and time $t_1$ is approximately in the range of 1 to 10 milli-seconds.

* * * * *